219-121 SR
4/14/87 XR 4,658,115

United States Patent [19]
Heath

[11] Patent Number: 4,658,115
[45] Date of Patent: Apr. 14, 1987

[54] LASER FIRED STEAM BOILER

[76] Inventor: Vernon Heath, 118 Walleye Ct., LaGrange, Ohio 44050

[21] Appl. No.: 824,553

[22] Filed: Jan. 23, 1986

[51] Int. Cl.[4] ..... F22B 00/00
[52] U.S. Cl. ..... 219/275; 219/276; 219/121 L; 219/121 LM
[58] Field of Search ..... 219/275, 271, 276, 121 L, 219/121 LM, 121 LS, 121 LV; 60/227

[56] References Cited

U.S. PATENT DOCUMENTS 3,289,101 11/1966 Masters et al. .
3,307,448 3/1967 Stimler et al. .
3,462,961 8/1969 Berard ..... 219/72
3,495,406 2/1970 Donatelli et al. .
3,586,816 6/1971 Hagen ..... 219/121 LR
3,876,852 4/1975 Topham ..... 219/72
3,971,913 7/1976 Myklebust ..... 219/275
4,002,880 1/1977 Davey et al. ..... 219/275
4,389,560 6/1983 Mitchell ..... 219/121 L
4,399,657 8/1983 Berry ..... 219/271

*Primary Examiner*—E. A. Goldberg
*Assistant Examiner*—Lincoln O. Donovan
*Attorney, Agent, or Firm*—Antonelli, Terry & Wands

[57] ABSTRACT

A method and apparatus of for producing vapor from a liquid using laser energy are disclosed. Liquid within a container is vaporized by directing at least one laser beam into the liquid in the container and retaining at least essentially all of the energy of the at least one laser beam in the container for vaporizing the liquid. The container is a boiler of a high pressure steam generator in the illustrated embodiment.

33 Claims, 4 Drawing Figures

LASER FIRED STEAM BOILER

BACKGROUND AND SUMMARY OF THE INVENTION

The present invention is directed to a method and apparatus for producing vapor from a liquid using laser energy, and particularly to a laser fired boiler of a steam generator.

Pollution of the environment in the production of steam for generating electric power and heat has become an increasing problem in recent years. The by-products of the combustion of coal released into the atmosphere and radiation leaks from nuclear power generating stations can be cited as examples. Thus, there is a need for an improved method and apparatus of producing vapor such as steam from a liquid without air pollution or radioactivity.

An object of the present invention is to provide a method and an apparatus for producing vapor such as steam from a liquid without air pollution or radio activity through the use of lasers.

This and other objects of the invention are obtained by the method of the invention for producing vapor from a liquid using laser energy which comprises the steps of providing a liquid to be vaporized in a container, directing at least one laser beam into the liquid into the container and retaining at least essentially all of the energy of the at least one laser beam in the container for vaporizing the liquid.

According to a disclosed preferred embodiment of the invention, a plurality of laser beams are directed into the liquid. The laser beams are directed so that they intersect one another in the liquid within the container. The energy of the laser beams is retained by providing a shield within the container which prevents passage of the laser beams and acts to absorb energy of the laser beams impinging thereon. The shield is in contact with the liquid within the container so as to transfer any heat in the shield to the liquid.

In the disclosed embodiment, the shield is spaced inwardly of an outer wall of a container with liquid being provided on inner and outer sides of the shield. The shield has a hollow, essentially closed form with openings therein through which the laser beams are directed for vaporizing the liquid. The shield is preferably formed in a plurality of segments which are releasably supported on the inner wall of the container.

Further, the method of the invention includes the step of replacing the liquid in the container which is vaporized. For this purpose the container has an opening in the bottom thereof through which liquid is introduced to replace the liquid in the container which has been vaporized. The method further includes the step of conveying vaporized liquid from the container. The vapor is conveyed from the container through an opening provided in the top of the container.

The method further includes the step of passing the at least one laser beam through a lens provided in the container before the laser beam enters the liquid within the container. In the disclosed embodiment of the method, the lens causes the laser beam to diverge as it passes through the liquid within the container. The liquid in the container in the disclosed embodiment is water.

The apparatus of the invention for producing vapor from a liquid using laser energy comprises a container in the form of a drum for the liquid to be vaporized. Means are provided for introducing at least one laser beam into liquid such as water provided in the container. The apparatus further includes means for retaining at least essentially all of the energy of the at least one laser beam in the container for vaporizing the liquid.

According to the disclosed form of the invention, the apparatus is a laser fired boiler of a high pressure steam generator. The container for liquid to be vaporized is a large, high strength metal drum which includes a plurality of spaced portions which are transparent to laser beams to permit a plurality of laser beams to be introduced into water provided in the drum. A shield is provided in the drum for obstructing and absorbing laser energy of the laser beams which impinge thereon. The shield is in contact with the water in the container for transferring its heat energy to the water.

The plurality of spaced transparent portions of the drum are formed by openings in the drum and lens holders which are sealingly secured to the drum about the openings. The lens holders extend from the drum to a corresponding opening in the shield within the container. The laser beams pass through respective lenses supported in the lens holders which cause the laser beams to diverge in the water within the container. The shield has a hollow essentially closed form with openings therein through which the laser beams are directed for vaporizing the liquid. To fully utilize the laser energy absorbed by the shield, liquid is provided on inner and outer sides of the shield.

These and other objects, features and advantages of the invention will become more apparent from the following description when taken in connection with the accompanying drawings which show, for purposes of illustration only, one preferred embodiment in accordance with the invention.

DESCRIPTION OF THE DISCLOSED EMBODIMENT

Figure 1:
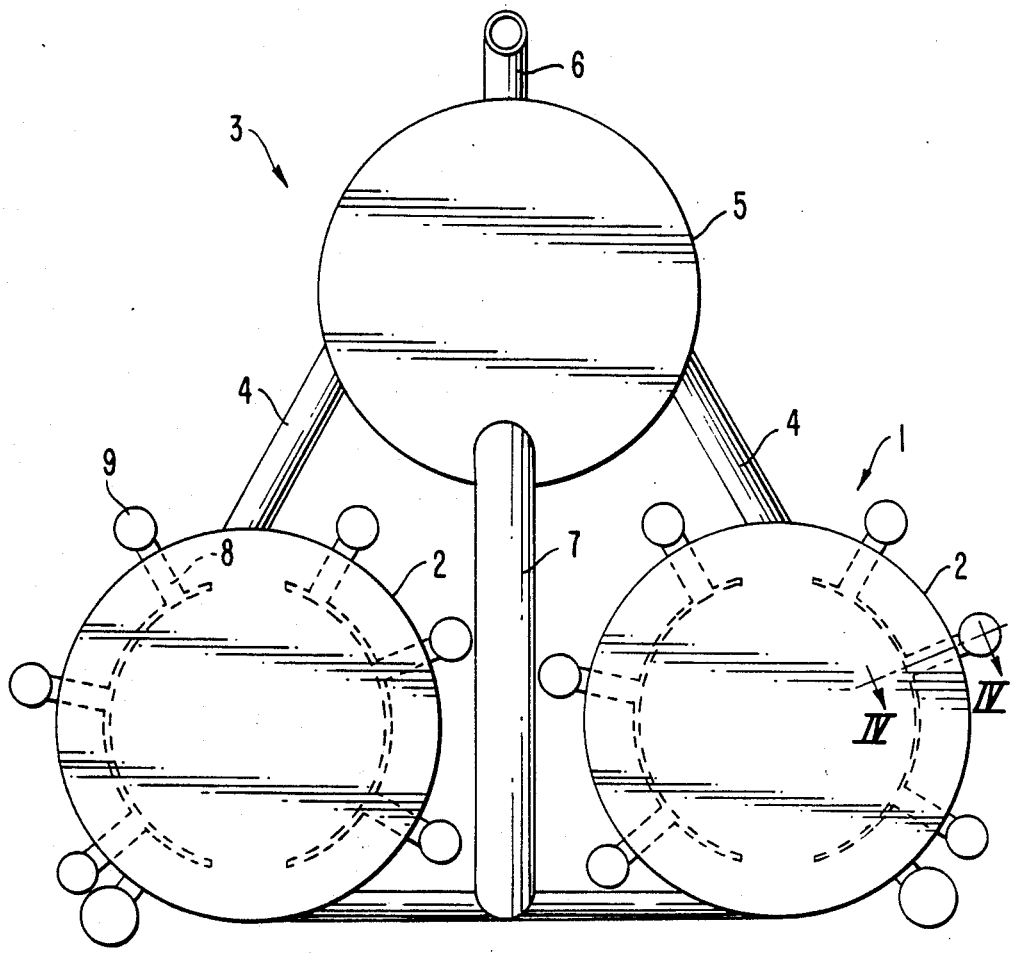
FIG. 1 is a schematic illustration, partially in cross-section, of a high pressure steam generator comprising a pair of laser fired boilers according to the present invention.

Referring now to the drawings, an apparatus 1 of the invention for producing vapor from a liquid using laser energy is seen to comprise a container 2 in the form of a drum for holding the liquid to be vaporized, typically water. The apparatus 1 is a laser fired boiler of a steam generator generally referred to as 3 in FIG. 1. More particularly, the steam generator 3 is a high pressure steam generator which includes a pair of the laser fired boilers 1 according to the invention. Risers 4 extend from the top of the containers 2 of the boilers to a steam drum 5 of the steam generator. A steam outlet 6 is, in turn, provided in an upper portion of the steam drum 5. Steam can be conveyed from the steam outlet 6 of the steam generator 3 for use in generating electric power, for heating purposes, etc. A downcomer distributor 7 extends from the lower portion of the steam drum 5 to the bottom of the containers 2 of the boilers for circulating liquid within the boilers to be vaporized.

The container 2 of each boiler 1 is preferably formed of a heat and corrosion resistant alloy such as stainless steel. Each drum may be 22 feet in length, 7 feet in inside diameter with a wall thickness of several inches or more, depending upon the pressure requirements of the boiler. The drum can be designed to withstand pressures of 1,000 lbs. per square inch or more.

Figure 2:
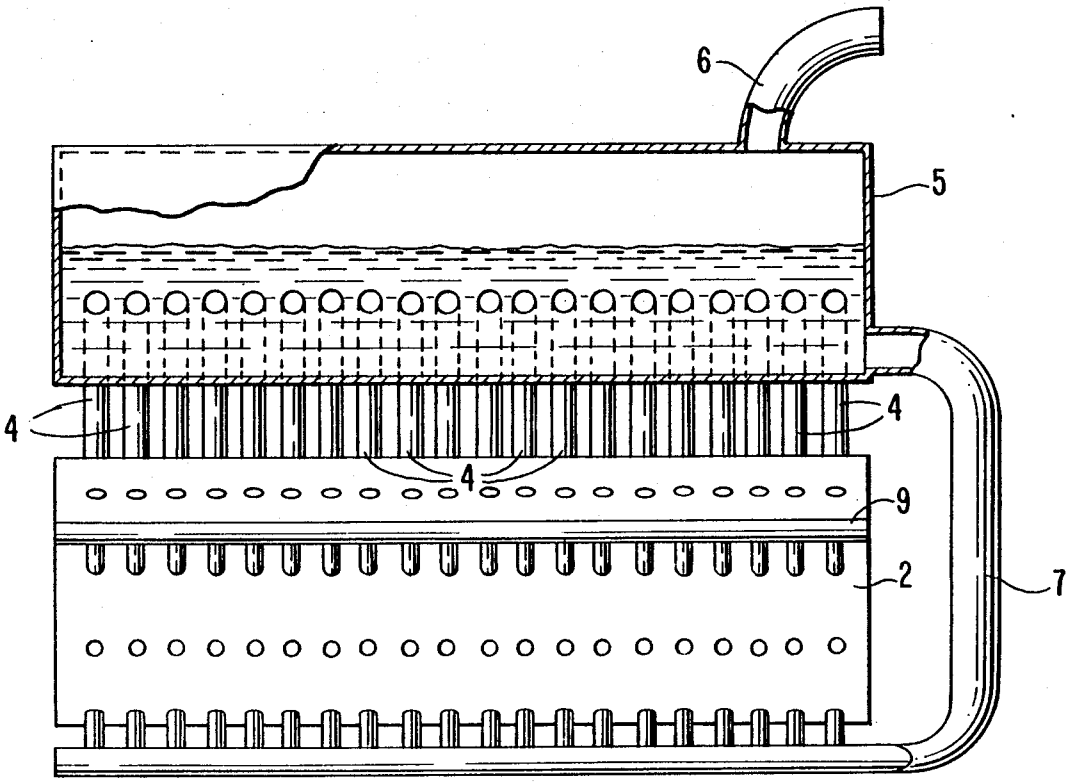
FIG. 2 is a side elevational view of one of the steam generator of FIG. 1 taken from the right side of the steam generator as illustrated in FIG. 1.
Figure 3:
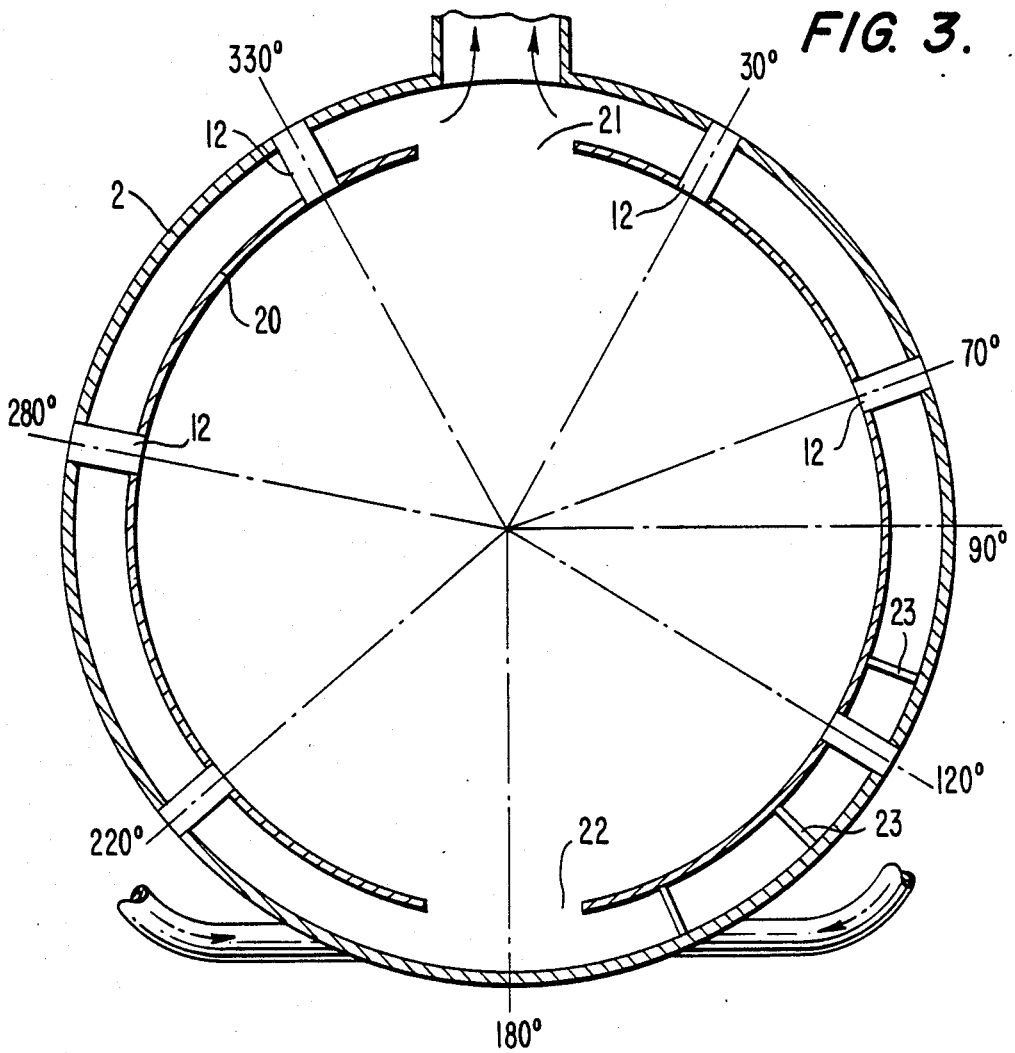
FIG. 3 is a cross-sectional view of the laser fired boiler shown in FIG. 2 taken along the line III—III.

The drum 2 is provided with a plurality of transparent portions 8 therein through which laser beams can be passed to the liquid within the container. As shown in FIG. 1 and in the cross-sectional illustration of FIG. 3, six transparent portions 8 are provided at spaced intervals in the outer wall of the drum about the circumference of the drum. A series of these spaced transparent portions are located along the length of the drum as depicted in FIG. 2 of the drawings. A single tube 9 extends on the length of the drum 2 adjacent a series or row of the transparent portions 8. A plurality of laser beams are split from a single laser beam directed into the tube 9 for introduction into the liquid within the drum 2 through the aligned, respective transparent portions 8. Specifically, the tube 9 is a metal tube containing splitters to split a laser beam directed along the length of the tube 9 into 20 equal parts, one for each aligned transparent portion 8, so as to direct each part to a separate transparent portion 8 where it passes into the drum 2 and the liquid therein. Six laser beam tubes 9 with splitters therein are used about each drum 2. Six laser generators, not shown, provide a laser beam to each of the respective splitting tubes 9 positioned around the circumference of the drum. The split beams are directed through the transparent portions 8 spaced about the circumference of the drum as shown in FIG. 3, so that the beams all meet at the center of the drum, and so that the beams are not aimed directly at another transparent portion 8. Each of the lasers can be a 1,000 watt pulsed laser which is pulsed at a rate of 200 times per second, for example. The laser beams preferably have a wave length in the infrared range of the electromagnetic spectrum with the respective laser beams of the six lasers being out of phase with each other to cause interference where they meet. Alternatively, a continuous emission laser such as a $CO_2$ gas discharge laser could be used to provide the laser beams to the tubes 9. The conventional beam splitters in the tubes 9 are not illustrated in the drawings.

Figure 4:
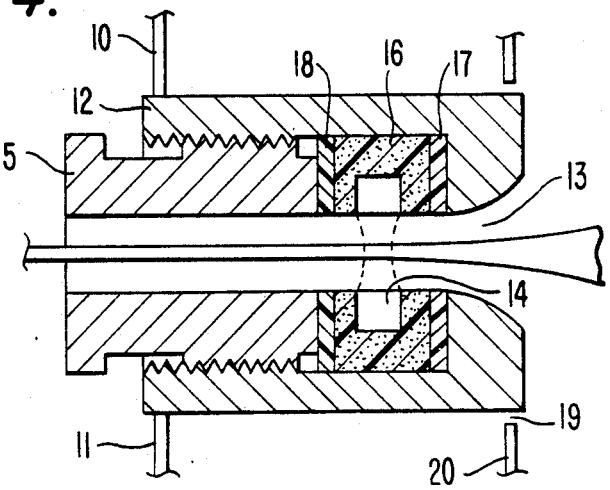
FIG. 4 is a cross-sectional view of a laser lens holder of the invention taken along the line IV—IV in FIG. 1.

The transparent portions 8 of the drum 2 are each formed by an opening 10 in the outer wall 11 of the drum 2 as shown in FIG. 4. A lens holder 12 is secured to the outer wall 11 about the opening 10 as by welding, for example, to close the opening 10 against the high pressure within the drum 2. The lens holder 12 has a central aperture 13 therethrough. A lens 14 extends across the aperture 13. The lens 14 is releasably sealed within the lens holder 12 by means of a threaded plug 15, gasket 16 and washers 17 and 18 as shown in FIG. 4. The lens is preferably a concave lens which causes the narrow, columnated laser beam to diverge inside the container. The lens holder 12 extends from the outer wall 11 of the drum 2 to a location within an opening 19 of a shield 20 provided in the drum 2.

The shield 20 positioned within the drum 2 is six feet in diameter in the illustrated embodiment and is constructed of ⅛ inch thick carbon steel. The shield extends the full length of the drum 2 and has openings 21 and 22 each approximately 18 inches wide which extend the full length of the shield at the top and bottom thereof to permit water circulation within the drum. The shield is preferably constructed in sections with keyhole shaped slots provided therein for hanging the sections on lugs 23 welded to the inside of the outer drum 2 as schematically shown in FIG. 3. In this way, the sections can be replaced individually, as needed, through a manhole (not shown) provided in the end of the drum. The shield 20 serves to retain the laser beams in the drum 2, so that essentially all of the energy of the beams may be used for vaporizing the liquid therein. In particular, it is noted that the shield is not transparent to the laser beams and, in addition, because of the relatively dark color of the iron material of the shield, it absorbs energy of the laser beams which impinge thereon. Water on both sides of the shield absorbs heat generated in the shield due to the impingement of the laser beams thereon. The openings 19 in the shield 20 for the lens holders 12 are slightly larger in diameter than the diameter of the lens holders to allow for expansion and contraction of the shield during operation of the apparatus.

The method of producing steam from water using laser energy with the apparatus 1 of the invention comprises the steps of providing water to be vaporized in the drum 2, directing a plurality of laser beams into the water in the drum and retaining at least essentially all of the energy of the laser beams in the container for vaporizing the liquid. The water can be treated with rust and scale limiting chemicals, if desired, but need not contain any additives. No particulate material has to be added to the water, since in the enclosed area within the drum 2, the water and shield will act as black bodies and absorb the laser energy introduced.

The laser beams directed into the water in the drum heat the water causing it to boil and produce steam which is conveyed from the drum 2 by way of the risers 4 to the steam drum 5 of the steam generator. Condensed vapor and additional liquid added to the generator from a liquid source (not shown) are introduced into the bottoms of the drums 2 by way of the downcomer distributor 7 to replace liquid vaporized in the drums 2. In marine applications, for example, the risers and downcomers should be connected together in such a manner that water circulation is continuous in all sections of the boiler. The risers and downcomers can each be 6 inches in diameter, for example, to insure good circulation of the steam and liquid.

While I have shown and described only one embodiment in accordance with the present invention, it is understood that the same is not limited thereto, but is susceptible to numerous changes and modifications as known to those skilled in the art. Therefore, I do not wish to be limited to the details shown and described herein, but intend to cover all such changes and modifications as are encompassed by the scope of the appended claims.

I claim:

1. A method of producing vapor from a liquid using laser energy comprising the steps of providing a liquid to be vaporized in a container, directing at least one laser beam into the liquid in the container and retaining at least essentially all of the energy of said at least one laser beam in the container for vaporizing said liquid by preventing said at least one laser beam directed into said liquid from leaving said liquid.

2. A method of producing vapor according to claim 1, wherein a plurality of laser beams are directed into said liquid.

3. A method of producing vapor according to claim 2, wherein said plurality of laser beams are split from a single laser beam before being directed into said liquid in the container.

4. A method of producing vapor according to claim 2, wherein said plurality of laser beams are directed so that they intersect one another in the liquid within the container.

5. A method of producing vapor according to claim 4, wherein said plurality of laser beams are out of phase with each other so that they interfere with each other when they meet in said liquid.

6. A method of producing vapor according to claim 1, wherein the energy of said at least one laser beam is retained by providing a shield within the container which prevents said at least one laser beam from leaving said liquid.

7. A method of producing vapor according to claim 6, wherein said shield is spaced inwardly of an outer wall of said container with said liquid being provided on inner and outer sides of said shield.

8. A method of producing vapor according to claim 6, wherein said shield has a hollow essentially closed form with at least one opening therein, said at least one laser beam being directed through said at least one opening for vaporizing said liquid.

9. A method of producing vapor according to claim 1, including the step of replacing the liquid in the container which is vaporized.

10. A method of producing vapor according to claim 9, wherein said container has an opening in the bottom thereof through which liquid is introduced in said step of replacing the liquid which has been vaporized.

11. A method of producing vapor according to claim 1, including the step of conveying vaporized liquid from the container.

12. A method of producing vapor according to claim 11, wherein the top of said container has an opening through which the vaporized liquid is conveyed from the container.

13. A method of producing vapor according to claim 1, including the step of passing said at least one laser beam through a lens provided in the container before the laser beam enters the liquid within the container.

14. A method of producing vapor according to claim 1, including the step of causing said at least one laser beam to diverge as it passes through said liquid within the container.

15. A method of producing vapor according to claim 1, wherein said liquid is water and said container is a boiler of a high pressure steam generator.

16. An apparatus for producing vapor from a liquid using laser energy comprising a container for a liquid to be vaporized, means for introducing at least one laser beam into liquid provided in said container, and means for preventing said at least one laser beam introduced into said liquid from leaving said liquid so that at least essentially all of the energy of said at least one laser beam is retained for vaporizing said liquid.

17. An apparatus for producing vapor according to claim 16, including means for introducing a plurality of laser beams into liquid provided in said container.

18. An apparatus according to claim 17, wherein said means for introducing a plurality of laser beams directs said laser beams so that they intersect one another in the liquid within the container.

19. An apparatus according to claim 16, wherein said means for introducing includes at least one laser transparent portion of said container.

20. An apparatus according to claim 19, wherein said transparent portion of said container includes a lens through which said laser beam is directed.

21. An apparatus according to claim 20, wherein said lens to causes said laser beam passing through it to diverge as it passes through the liquid within the container.

22. An apparatus according to claim 20, wherein said lens is mounted in a lens holder which is secured to an outer wall of said container.

23. An apparatus according to claim 16, wherein said means for retaining laser energy includes a shield for absorbing laser energy of said at least one laser beam which impinges thereon.

24. An apparatus according to claim 16, wherein said means for retaining laser energy includes a shield which prevents said at least one laser beam from leaving said liquid.

25. An apparatus according to claim 24, wherein said shield has a hollow essentially closed form with at least one opening therein through which said at least one laser beam is directed for vaporizing said liquid.

26. An apparatus according to claim 16, wherein said means for retaining laser energy includes a shield located inwardly of an outer wall of said container with said liquid being provided on inner and outer sides of said shield.

27. An apparatus according to claim 26, wherein a lens holder extends between an opening in the shield and an opening in the outer wall of the container, said lens holder supporting a lens through which said at least one laser beam is introduced into said liquid.

28. An apparatus according to claim 16, further including means for replacing liquid which is vaporized in said container.

29. An apparatus according to claim 28, wherein said means for replacing liquid includes an opening in the bottom of said container and means for introducing liquid into said container through the opening.

30. An apparatus according to claim 16, further including means for conveying vaporized liquid from the container.

31. An apparatus according to claim 30, wherein said means for conveying includes an opening in the top of said container through which said vaporized liquid is conveyed from said container.

32. An apparatus according to claim 16, wherein said container is a boiler of a high pressure steam generator.

33. A laser fired boiler of a steam generator comprising a drum containing water to be vaporized, a plurality of spaced portions of said drum being transparent to laser beams to permit a plurality of laser beams to be introduced into water provided in the drum, laser means for providing a plurality of laser beams for introduction through said plurality of spaced transparent portions into water in said drum for vaporizing water to produce steam, a shield provided in said drum for absorbing laser energy of said laser beams which impinge thereon, said shield being in contact with the water in said container, means for conveying steam from said drum and means for replacing water in said drum which has been vaporized.

* * * * *